US005924631A

United States Patent [19]

Rodrigues et al.

[11] Patent Number: 5,924,631

[45] Date of Patent: Jul. 20, 1999

[54] TRIBOELECTRIC PROJECTOR, INSTALLATION FOR PROJECTING COATING PRODUCT AND PROCESS FOR CONTROLLING SUCH A PROJECTOR

[75] Inventors: José Rodrigues, Vif; Daniel Belmain, Vaulnaveys-le-Haut; Thierry Barlet, Eybens, all of France

[73] Assignee: Sames SA, Meylan, France

[21] Appl. No.: 08/889,676

[22] Filed: Jul. 8, 1997

[30] Foreign Application Priority Data

Jul. 10, 1996 [FR] France ..... 96 08894

[51] Int. Cl.[6] ..... B05B 5/027

[52] U.S. Cl. ..... 239/3; 239/692; 239/704

[58] Field of Search ..... 239/704–708, 239/3, 692

[56] References Cited

U.S. PATENT DOCUMENTS 4,359,192 11/1982 Takahashi et al. ..... 239/692
4,798,340 1/1989 Vohniger et al. ..... 239/705
4,979,680 12/1990 Bauch et al. ..... 239/704
5,620,138 4/1997 Crum ..... 239/704
5,622,313 4/1997 Lader et al. ..... 239/704

*Primary Examiner*—Kevin Weldon
*Attorney, Agent, or Firm*—Wallenstein & Wagner, Ltd.

[57] ABSTRACT

This invention relates to a triboelectric projector of pulverulent coating product, comprising a channel for charging the coating product, a supply conduit connecting a source of coating product to said projector, a mixture of air and of coating product circulating in said conduit, an injector of air for dilution and/or acceleration of said mixture of air and coating product, characterized in that the outlet orifice of said injector is disposed on the path of said mixture of air and coating product in an inner chamber of the projector, downstream of the admission of said conduit in said projector and upstream of the inlet of the charging channel. The invention also relates to a process for controlling such a projector, consisting in measuring the charge obtained in the charging channel and in servo-controlling by this charge the instantaneous flowrate of air injected by the injector.

9 Claims, 2 Drawing Sheets

TRIBOELECTRIC PROJECTOR, INSTALLATION FOR PROJECTING COATING PRODUCT AND PROCESS FOR CONTROLLING SUCH A PROJECTOR

FIELD OF THE INVENTION

The present invention relates to a triboelectric projector of a pulverulent coating product, to a proces for controlling such a projector and to an installation for projecting coating product comprising such a projector.

BACKGROUND OF THE INVENTION

A triboelectric projector of pulverulent coating product is a projector in which the electrostatic charge of the coating product is obtained by rubbing contact of the particles of the coating product against one or more surfaces made of insulating material disposed along their path. A projector of this type generally comprises a channel for charging the coating product and is supplied from a source of coating product such as for example a reservoir of fluidized powder, through a supply conduit in which a mixture of air and of coating product circulates. It is known, for example by Application EP-A1-0 627 265, to provide an additional air admission in the projector near the admission of the conduit supplying the mixture of air and coating product.

In the known devices of the prior art, an essential problem resides in the fact that it is not possible to control the electrostatic charge obtained by friction by means of a simple parameter.

In fact, in the device of EP-A1-0 627 265, the air is injected substantially perpendicularly to the principal axis of the jet pipe of the projector, at right angles with respect to the admission of the conduit supplying the mixture of air and coating product. This generates turbulences in the mixture of air and coating product which create complex phenomena. These phenomena have an influence on the triboelectric charge obtained. In addition, such turbulences cause wear of the parts constituting the projector at the level of the admission chamber of the mixture of air and coating product, with the result that operations of maintenance of the projector must be provided at regular intervals.

The invention solves all these problems by proposing a triboelectric projector in which the triboelectric charge obtained may be controlled precisely thanks to the flowrate of air for dilution and/or acceleration injected in the projector and in which the phenomena of wear are reduced compared with the prior art.

SUMMARY OF THE INVENTION

To that end, the invention relates to a triboelectric projector of pulverulent coating product, comprising a channel for charging coating product, a supply conduit connecting a source of coating product to said projector, a mixture of air and of coating product circulating in said conduit, an injector of air for dilution and/or acceleration of said mixture of air and coating product, characterized in that the outlet orifice of said injector is disposed on the path of said mixture of air and coating product in an inner chamber of said projector, downstream of the admission of said conduit in said projector and upstream of the inlet of said charging channel.

Thanks to the invention, incorporation of the dilution and/or acceleration air in the mixture of air and of coating product opening via the admission of the supply conduit, takes place efficiently and without phenomenon of turbulence capable of generating premature wear of the parts constituting the projectors. Moreover, the triboelectric charge may be controlled thanks to the flowrate of dilution and/or acceleration air delivered through the injector to the mixture of air and coating product.

According to a first advantageous aspect of the invention, the outlet of the injector is disposed substantially on the axis of symmetry of the charging channel, with the result that the jet of dilution and/or acceleration air is directed directly and symmetrically in the charging channel. Thanks to this aspect of the invention, it has been demonstrated that the triboelectric charge of the powder forming the coating material may be controlled thanks to the injector, and this independently of the flowrate of air used in a Venturi pump connected upstream of the supply conduit.

According to another advantageous aspect of the invention, the charging channel may be provided to be formed by an outer tube and by a central core of electrically insulating material, the outer tube being provided on its outer face with an electrically conducting layer connected to earth through a current measuring device. Thanks to this aspect of the invention, it is possible to measure the triboelectric charge obtained, the latter being proportional to the current detected by the measuring device.

In addition, the projector may be provided to comprise means for monitoring the instantaneous flowrate of air injected by the injector, these monitoring means being controlled from the value detected by the current measuring device.

According to another advantageous aspect of the invention, the conduit supplying the mixture of air and coating product opens out axially in the projector, which makes it possible to limit the phenomena of turbulence and therefore wear of the projector, further.

The invention also relates to an installation for projecting coating product, comprising a projector according to the invention.

Finally, the invention relates to a process for controlling a triboelectric projector which may be carried out with the projector of the invention. This process is characterized in that it consists in measuring the charge obtained in the charging channel and in servo-controlling the instantaneous flowrate of air injected by the injector, by this charge obtained in the charging channel.

Thanks to the process of the invention, the instantaneous flowrate of injected air is maintained at an optimum value as a function of the triboelectric charge to be obtained.

According to an advantageous aspect of the process of the invention, it further consists in measuring the value of the earth return current of a conducting element disposed in contact with an element constituting the charging channel. This aspect of the process of the invention is a practical and simple alternative for measuring the charge obtained in the charging channel.

BRIEF DESCRIPTION OF THE DRAWINGS

The invention will be more readily understood on reading the following description of an embodiment according to the invention of a triboelectric projector of pulverulent coating product given solely by way of example, with reference to the accompanying drawings in which.

DESCRIPTION OF PREFERRED EMBODIMENT

Figure 1:
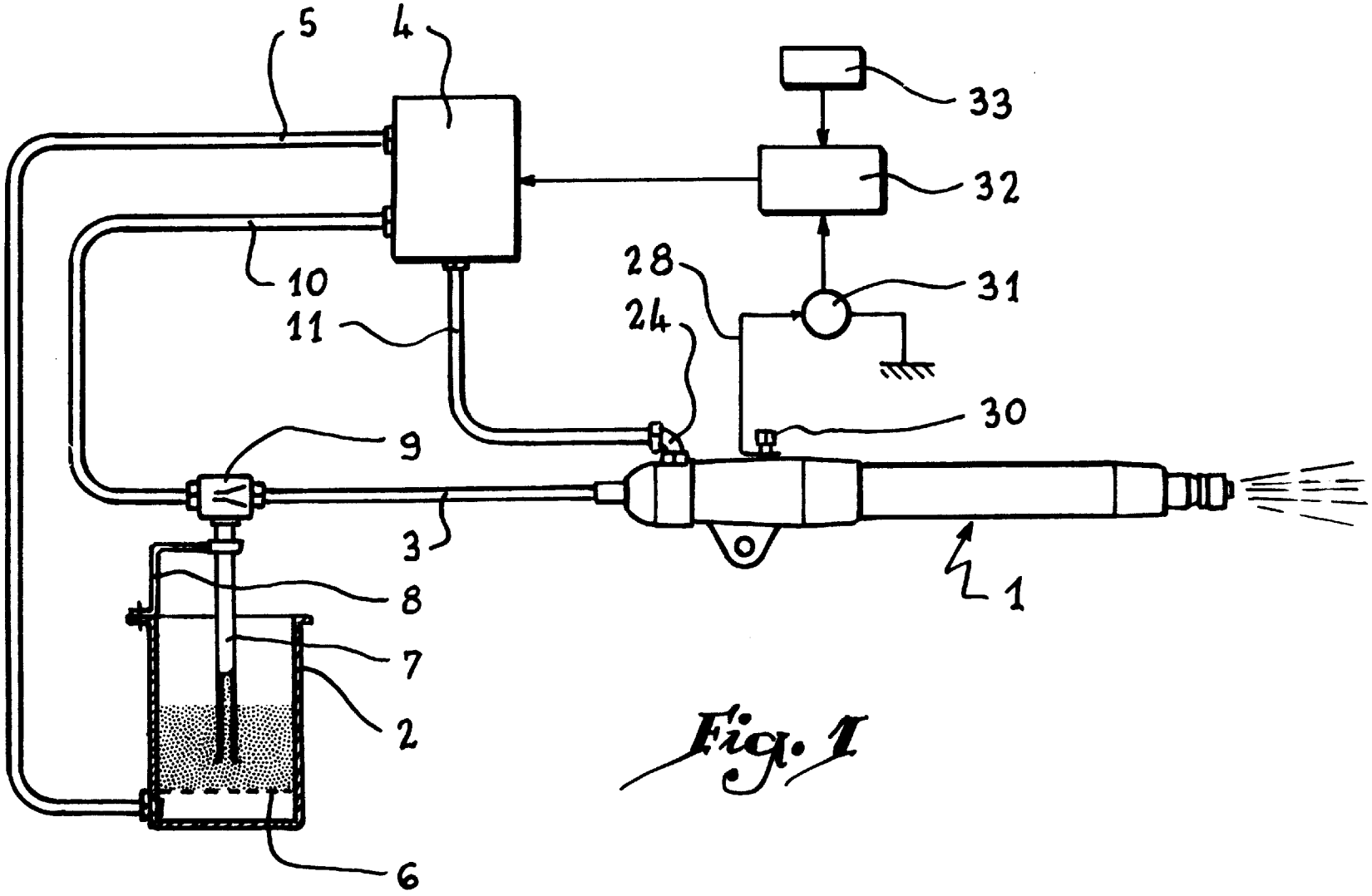
FIG. 1 is a skeleton diagram of the installation of a triboelectric projector of pulverulent coating product according to the invention.

Referring now to the drawings, and firstly to FIG. 1, a triboelectric project 1 of pulverulent coating product is supplied from a reservoir 2 of coating product in powder form via a supply conduit 3 which may be supple. The powder contained in the reservoir 2 is placed in suspension by a flux of air delivered by a controlled source 4 though a pipe 5 and traversing a porous plate 6. An immersion tube 7 is supported by a mount 8 above the reservoir 2 so that its lower end penetrates in the powder in suspension. A Venturi pump 9 mounted at the upper end of the tube 7 is supplied by the controlled source 4 through a pipe 10. The air injected by the pipe 10 in the Venturi pump 9 sucks the powder in suspension via the tube 7 and injects it in the supply conduit 3. The projector 1 is thus supplied with a mixture of air and coating product. A pipe 11 connects the controlled source 4 to the projector 1 whose structure is more clearly visible in FIG. 2. The pipe 11 makes it possible to supply the projector 1 with air for dilution and/or acceleration of the mixture of air and coating product which circulates in the conduit 3.

Figure 2:
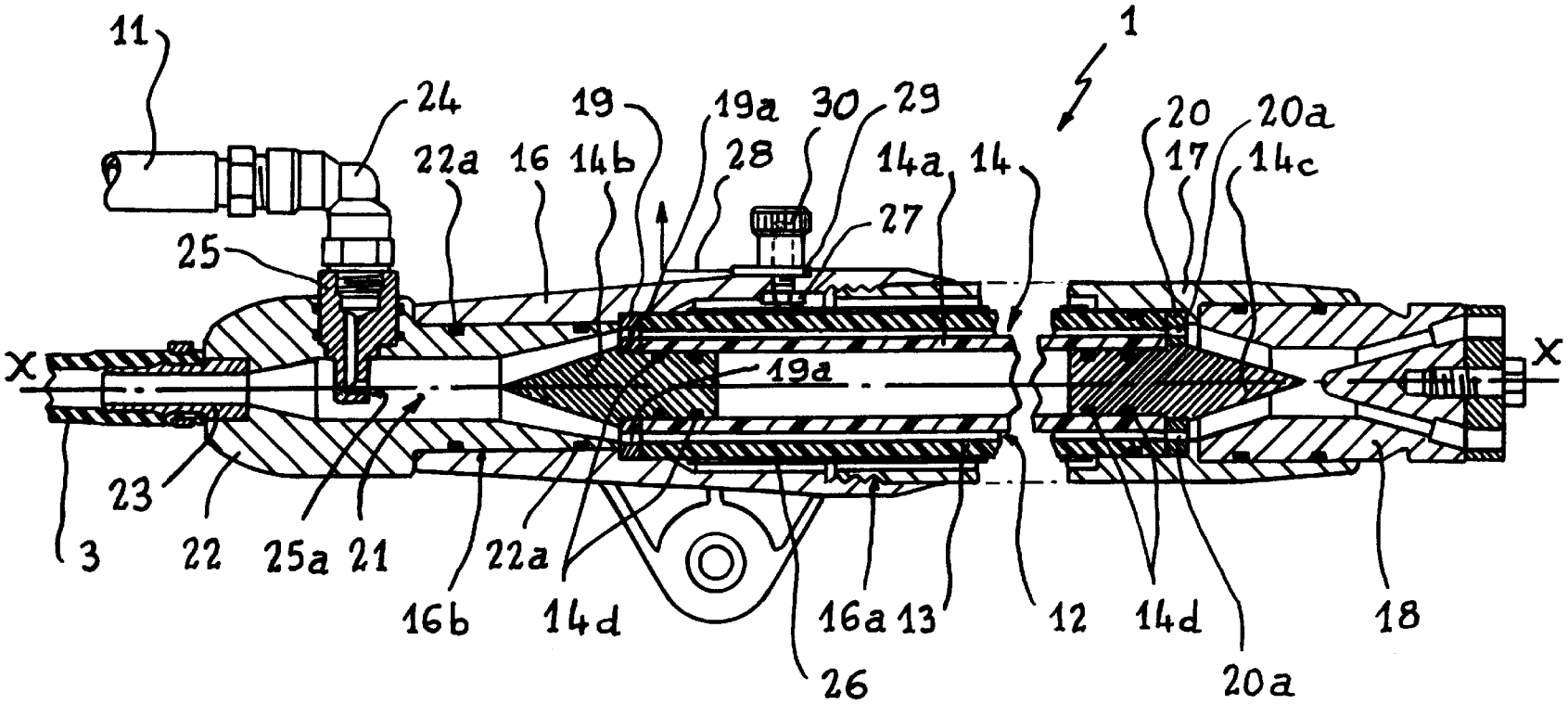
FIG. 2 is a view in longitudinal section of the projector of FIG. 1.

As shown in FIG. 2, the projector 1 is essentially composed of a charging channel 12 defined between an outer tube 13 and a central core 14 formed by a tube 14*a* and two stoppers 14*b* and 14*c* whose outer shape is conical, adapted to be partially fitted in the ends of the tube 14*a*. Each stopper 14*b* and 14*c* bears two O-rings 14*d* whose function is to immobilize it inside the tube 14*a*.

The projector also comprises a body 16 provided with a tapped orifice 16*a* inside which may be screwed a jet pipe 17 enveloping the whole of the structure forming the feed channel 12. At the downstream end of the jet pipe 17 there may be mounted a projection nozzle 18 whose outlet section, single or multiple, is chosen as a function of the desired shape of the jet of air-powder mixture. Two rings 19 and 20 are respectively mounted at the upstream end and at the downstream end of the charging channel 12 so as to immobilize the central core 14 inside the body 16 and the jet pipe 17, this making it possible to create the channel 12 between the inner surface of the outer tube 13 and the outer surface of the inner tube 14*a*.

The inlet of the charging channel 12 is defined by orifices 19*a* pierced in the ring 19 through which the mixture of air and coating product circulates. An inner mixing chamber 21 is formed, upstream of the inlet of the charging channel, in an endpiece 22 fitted in a central orifice 16*b* of the body 16. The endpiece 22 bears on its outer surface two O-rings 22*a* intended to immobilize it inside the orifice 16*b*. The supply conduit 3 is connected to the endpiece 22 thanks to a connection 23 and opens out axially in the chamber 21, i.e. in the direction of the axis of symmetry XX' of the charging channel which is the principal axis of the projector.

On the other hand, and according to the invention, the pipe 11 is connected to the interior of the chamber 21 thanks to an elbow 24 mounted on an injector 25 of which the outlet orifice 25*a* is disposed in the chamber 21 on the path of the mixture of air and coating product in the projector 1 downstream of the admission of the conduit 3 in the chamber 21 and upstream of the inlet 19*a* of the charging channel 12.

It may be noted in particular that the orifice 25*a* is disposed substantially on the axis XX', with the result that the air injected through the injector 25 is directed towards the charging channel in a direction parallel to and in the same sense as that of the mixture of air and coating product penetrating in the chamber 21 via the connection 23. In this way, the turbulences generated in the chamber 21 are minimum and the wear of the endpiece 22 is slight in the course of time, which makes it possible to reduce the exploitation costs of the triboelectric projector of the invention compared with the devices of the prior art, as the connection 23 which constitutes the inlet or outlet of the charging channel 3 and the orifice 25*a* of the injector 25 are disposed along the axis XX'. The mixture of air and coating product penetrating in the chamber 21 via the connection 23 strikes the rear of the injector 25, which has for its effect to distribute the mixture of air and coating product in the chamber 21 and around the stopper 14*b*.

In addition, the air injected through the orifice 25*a* has a flowrate which may be controlled by the source 4 independently of the flowrate of air injected in the Venturi pump 9, with the result that the velocity of the mixture of air and coating product in the channel 12 may be controlled by the source 4 through the pipe 11 independently of the flowrate of powder sucked by the pump 9. This velocity of the mixture in the channel 12 is linked with the triboelectric charge obtained and it has been demonstrated by experiment that, thanks to the invention, the triboelectric charge obtained is substantially proportional to the flowrate of air injected via the injector 25. This therefore makes it possible to control the charge obtained in the device.

More specifically, a carbon-fiber conducting tube 26 is housed in the jet pipe 17 around the outer tube 13 in contact therewith over the greater part of its length. The tube 26 therefore appears as a drain of the electrostatic charges transmitted to the outer tube 13 by the particles of powder. The tube 26 is in abutment against a metal screw 27 whose shank is connected to earth by an electric cable 28. In this way, an electric current passes through tube 26 in the direction of earth. The end of the cable 28 is welded on a washer 29 maintained in position on the shank of the screw 27 by a knob 30.

A current-measuring device 31, such as an ammeter, is disposed on the cable 28. The value of the current measured by the ammeter 31 is proportional to the triboelectric charge obtained in the channel 12 and may therefore be considered as representative of this charge. In practice, the value of the current detected by the ammeter 31 is transmitted as input variable to a control unit 32 formed for example by a programmable automat or a micro-computer, which constitutes a means for monitoring the controlled source 4. More precisely, when a triboelectric charge value is desired, it is finished to the unit 32 as reference value by a capturing device such as a keyboard 33. With this value there is associated, experimentally or by calculation, a reference value of the current in the cable 28. During operation, the value of the current in the cable 28 is permanently furnished to the automat or micro-computer 32 and the latter controls the source 4 so that, if the value of the current measured by the ammeter 31 is less than the reference value, the flowrate in the pipe 11 is increased, i.e. the flowrate of air for acceleration and/or dilution injected through the injector 25 is increased. If, on the contrary, the value of the current measured by the ammeter 31 is greater than the reference value, the monitoring means 32 controls the source 4 so that the flowrate in the pipe 11 is reduced. In this way, the flowrate of air injected by the injector 25 is controlled, thanks to the monitoring means 32, by a regulation loop having for manipulated variable the value detected by the current measuring device constituted by the ammeter 31.

In other words, we have a process for controlling the projector 1, characterized in that it consists in measuring the charge obtained in the charging channel 12 and in servo-controlling, thanks to the automat or computer 32, the instantaneous flowrate of air injected by the source 4 in the pipe 11 through the injector 25, by the charge obtained in the channel 12. This process further consists in measuring the value of the earth return current of the conductor element 26 which is disposed in contact with the tube 13, and in using this value as a variable representative of the charge obtained in the channel.

The invention has been presented with an automatic triboelectric projector, but it is obvious for the man skilled in the art that it is also applicable to a manual projector.

What is claimed is:

1. A triboelectric projector of pulverulent coating product, comprising a channel for charging the coating product, a supply conduit connecting a source of coating product to said projector, a supply of coating product conveyed in a stream of air having a trajectory and circulating in said conduit, an injector of air for dilution and/or acceleration of said coating product, wherein an outlet orifice of said injector is disposed along the trajectory of said coating product in an inner chamber of said projector, downstream of an outlet of said conduit in said projector and upstream of the inlet of said charging channel.

2. The triboelectric projector of claim 1, wherein the outlet orifice of said injector is disposed substantially on an axis of symmetry of said charging channel.

3. The triboelectric projector of claim 1, wherein the charging channel is formed by an outer tube and a central core made of electrically insulating material, said outer tube being provided, on its outer face, with an electrically conducting layer connected to earth through a current measuring device.

4. The triboelectric projector of claim 3, wherein the projector comprises means for monitoring the instantaneous flowrate of air injected by said injector, said monitoring means being controlled by a computer according to the value detected by said current measuring device.

5. The triboelectric projector of claim 4, wherein said flowrate of air injected by said injector is controlled by a regulation loop which uses a variable parameter which has the value detected by said current measuring device.

6. The triboelectric projector of claim 5, wherein the conduit supplying the mixture of air and coating product opens out axially in said projector.

7. Process for controlling a triboelectric projector of pulverulent coating product comprising a channel for charging the coating product, a supply conduit connecting a source of coating product to said projector, a mixture of air and coating product circulating in said conduit, an injector of air for dilution and/or acceleration of said mixture of air and coating product, wherein the process comprises the steps of:

measuring the charge obtained in said charging channel and controlling the instantaneous flowrate of air injected by said injector, by linking said flowrate to said charge obtained in said charging channel.

8. The process of claim 7, wherein the process further comprises measuring the value of the earth return current of a conducting element disposed in contact with an element constituting said charging channel, and in using the value thus obtained as a variable representative of the charge obtained in said channel.

9. A triboelectric projector of pulverulent coating product, comprising a channel for charging coating product;

a supply conduit connecting a source of coating product to said projector, said supply conduit having an outlet in said projector, which is substantially axial with an axis of symmetry of said charging channel; and, an injector of air for dilution and/or acceleration of said mixture, wherein an outlet orifice of said injector is disposed substantially on the axis of symmetry of said charging channel, downstream of an outlet of said supply conduit in said projector and upstream of the inlet of said charging channel.

* * * * *